US009475320B2

(12) United States Patent
Shiina

(10) Patent No.: US 9,475,320 B2
(45) Date of Patent: Oct. 25, 2016

(54) DOOR OPENING AND CLOSING DEVICE

(71) Applicant: RISO KAGAKU CORPORATION, Tokyo (JP)

(72) Inventor: Kensuke Shiina, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/810,015

(22) Filed: Jul. 27, 2015

(65) Prior Publication Data

US 2016/0024836 A1 Jan. 28, 2016

(30) Foreign Application Priority Data

Jul. 28, 2014 (JP) ..... 2014-152981

(51) Int. Cl.
*B41J 29/13* (2006.01)
*B41J 11/00* (2006.01)

(52) U.S. Cl.
CPC ..... *B41J 29/13* (2013.01); *B41J 11/006* (2013.01); *B65H 2402/45* (2013.01); *B65H 2601/11* (2013.01)

(58) Field of Classification Search
CPC ..... E06B 3/38; E06B 5/00; B41J 29/13; B41J 11/006; H05K 5/03; B65H 2402/45; B65H 2601/11
See application file for complete search history.

(56) References Cited

U.S. PATENT DOCUMENTS 5,573,235 A * 11/1996 Asai ..... B65H 1/12 271/121
6,022,158 A * 2/2000 Nakayama ..... B41J 11/48 101/93
6,494,633 B1 * 12/2002 Crosby ..... B41J 3/36 400/663
2003/0081018 A1 * 5/2003 Kinsley ..... B41J 29/13 347/2
2007/0116506 A1 * 5/2007 Portig ..... B41J 29/02 400/691
2007/0211131 A1 * 9/2007 Iijima ..... B41J 2/1752 347/108
2008/0025001 A1 * 1/2008 Igarashi ..... B41J 29/13 361/726
2011/0026999 A1 * 2/2011 Kohira ..... B26D 1/085 400/621
2012/0305583 A1 * 12/2012 Ortiz Mompel ..... B41J 29/13 220/827
2012/0328325 A1 * 12/2012 Sato ..... G03G 21/1623 399/110
2012/0328327 A1 * 12/2012 Sato ..... G03G 15/0189 399/110
2013/0044174 A1 * 2/2013 Takemura ..... B41J 29/13 347/108
2013/0106965 A1 * 5/2013 Yamamoto ..... B41J 29/13 347/86
2013/0108346 A1 * 5/2013 Preliasco ..... B41J 17/02 400/611
2013/0286111 A1 * 10/2013 Kelly ..... B41J 2/1752 347/86
2014/0205356 A1 * 7/2014 Mistyurik ..... B41J 3/4075 400/613
2015/0001794 A1 * 1/2015 Doi ..... B65H 1/04 271/264
2015/0084488 A1 * 3/2015 Vellutato, Jr. ..... A47B 81/00 312/34.4

FOREIGN PATENT DOCUMENTS

JP 2003-209373 7/2003
JP 2009-014969 1/2009

* cited by examiner

*Primary Examiner* — Justin Rephann
(74) *Attorney, Agent, or Firm* — Hamre, Schumann, Mueller & Larson, P.C.

(57) ABSTRACT

A door opening and closing device includes, a door supporting portion for supporting an axial side of a door, a door receiving portion inclined to the door supporting portion for receiving an open-send side of the door, an opening formed from the door supporting portion to the door receiving portion to be opened and closed by the door, a first support point made by a combination of a shaft attached to the axial side of the door and an elongated hole formed on the door supporting portion, and a second support point provided at an intermediate portion between the axial side and the open-end side of the door and capable of freely contacting-with and separated-from the door receiving portion. The open-end side is angled to the axial side to have an angle therebetween in accordance with an inclined angle of the door receiving portion to the door supporting portion.

2 Claims, 9 Drawing Sheets

DOOR OPENING AND CLOSING DEVICE

BACKGROUND OF THE INVENTION

1. Technical Field

The present invention relates to a door opening and closing device that enables a door to be closed tightly and to be widely opened.

2. Background Arts

Generally, a door opening and closing device is adopted in various apparatuses and machines, and used for opening and closing a door formed on a main body of a certain apparatus (machine).

A Patent Document 1 (Japanese Patent Application Publication No. 2009-14969) discloses an image forming apparatus provided with such a door opening and closing device. In the image forming apparatus, an opening used for clearing a paper jam or replacing a service part is opened and closed by a door, and the door is opened and closed by the door opening and closing device.

External auxiliary devices can be connected with the image forming apparatus. Specifically, a large-capacity paper feeder as the auxiliary device can be connected with a right side panel of the image forming apparatus, and a post-processing device as the auxiliary device is connected with a left side panel of the image forming apparatus. An opening for clearing a paper jam or replacing a service part is formed on each of the side panels, and the opening is opened and closed by a door.

When a user has to clear a paper jam or replace a service part, it is necessary to open the door in order to access the opening after moving the large-capacity paper feeder or the post-processing device. If the door is supported by well-known hinges and swingably opened and closed, a space required for opening and closing the door becomes large. Therefore, the door(s) on the side panel (s) disclosed in the Patent Document 1 is laterally slid to a front side of the image forming apparatus. Guide members in a pair are provided parallel to each other along upper and lower edges of the opening.

According to the door opening and closing device disclosed in the patent Document 1, a distance required for inevitably moving the auxiliary device(s) of the image forming apparatus can be shortened when clearing a paper jam or replacing a service part, compared with an apparatus provided with a hinge-type door. In addition, a space to be secured around the apparatus can be saved. Further, operability for clearing a paper jam or replacing a service part can be improved.

A Patent Document 2 (Japanese Patent Application Publication No. 2003-209373) discloses another door opening and closing device adopted in an electrical instrument. The door opening and closing device includes a pair of protrusions that serve as hinge pins and are coaxially protruded outward in an opposite direction from a door. The hinge pins are inserted into reception holes. End surfaces of the hinge pins and bottom surfaces of the reception holes are formed as inclined surfaces that are inclined with respect to an axis of the hinge pins.

According to the door opening and closing device disclosed in the patent Document 2, the inclined surface of the hinge pin and the inclined surface of the insertion hole are parallel when the door is closed. These two inclined surfaces are twisted about the axis when the door is opened, and thereby they function as a dumper.

SUMMARY OF THE INVENTION

However, when clearing a paper jam or replacing a service part in the door opening and closing device disclosed in the Patent Document 1, it is needed to access the door provided on the left side panel or the right side panel of the image forming apparatus and then open the door. Therefore, the external auxiliary device(s) must be separated away from the image forming apparatus to access the door. This means that an additional work of separating the external auxiliary device(s) from the image forming apparatus is needed, so that it takes more time to clear a paper jam or to replace a service part.

In the door opening and closing device disclosed in the Patent Document 2, an opening or closing failure caused by looseness of the hinges (the hinge pins and the reception holes) can be prevented by forming the inclined surfaces on the hinge pins and the reception holes. However, workability of forming the inclined surfaces on the hinge pins and the reception holes is not good. In addition, a function for tightly closing the opening(s) is not provided in the door opening and closing device disclosed in the Patent Document 2. Further, a function for opening the door more widely is not provided in the door opening and closing device disclosed in the Patent Document 2.

An object of the present invention is to provide an inkjet image forming apparatus and a cleaning method for the apparatus that can prevent increase of an amount of ink used in a flush process and can prolong a replacement cycle of a mist-absorbing material.

A first aspect of the present invention provides a door opening and closing device comprising: a door that is capable of being opened and closed; a door supporting portion that supports an axial side of the door; a door receiving portion that is continued from the door supporting portion to be inclined to the door supporting portion, and receives an open-send side of the door; an opening that is formed from the door supporting portion to the door receiving portion, and is opened and closed by the door; a first support point that is made by a combination of a shaft attached to one of the axial side of the door and the door supporting portion, and an elongated hole formed on another of the axial side of the door and the door supporting portion; and a second support point that is provided at an intermediate portion between the axial side and the open-end side of the door, and is capable of freely contacting with the door receiving portion and freely separated from the door receiving portion, wherein the open-end side of the door from the second support point is angled to the axial side of the door from the second support point to have an angle therebetween in accordance with an inclined angle of the door receiving portion to the door supporting portion, and the door is opened further by the combination and the shaft and the elongated hole.

A second aspect of the present invention provides a door opening and closing device comprising: a door that is capable of being opened and closed; a door supporting portion that supports an axial side of the door; a door receiving portion that is continued from the door supporting portion, and receives an open-send side of the door; an opening that is formed from the door supporting portion to the door receiving portion, and is opened and closed by the door; a first support point that is made by a combination of a shaft attached to one of the axial side of the door and the door supporting portion, and an elongated hole formed on another of the axial side of the door and the door supporting portion; and a second support point that is provided at an intermediate portion between the axial side and the open-end side of the door, and is capable of freely contacting with the door receiving portion and freely separated from the door receiving portion, wherein the door is configured to swing the axial side thereof about the first support point to close the door, and then to swing the open-end side thereof about the second support due to an own weight thereof to close the door tightly.

DESCRIPTION OF THE EMBODIMENT

Hereinafter, a door opening and closing device 50 according to an embodiment will be described with reference to FIG. 1 to FIG. 10.

Figure 1:
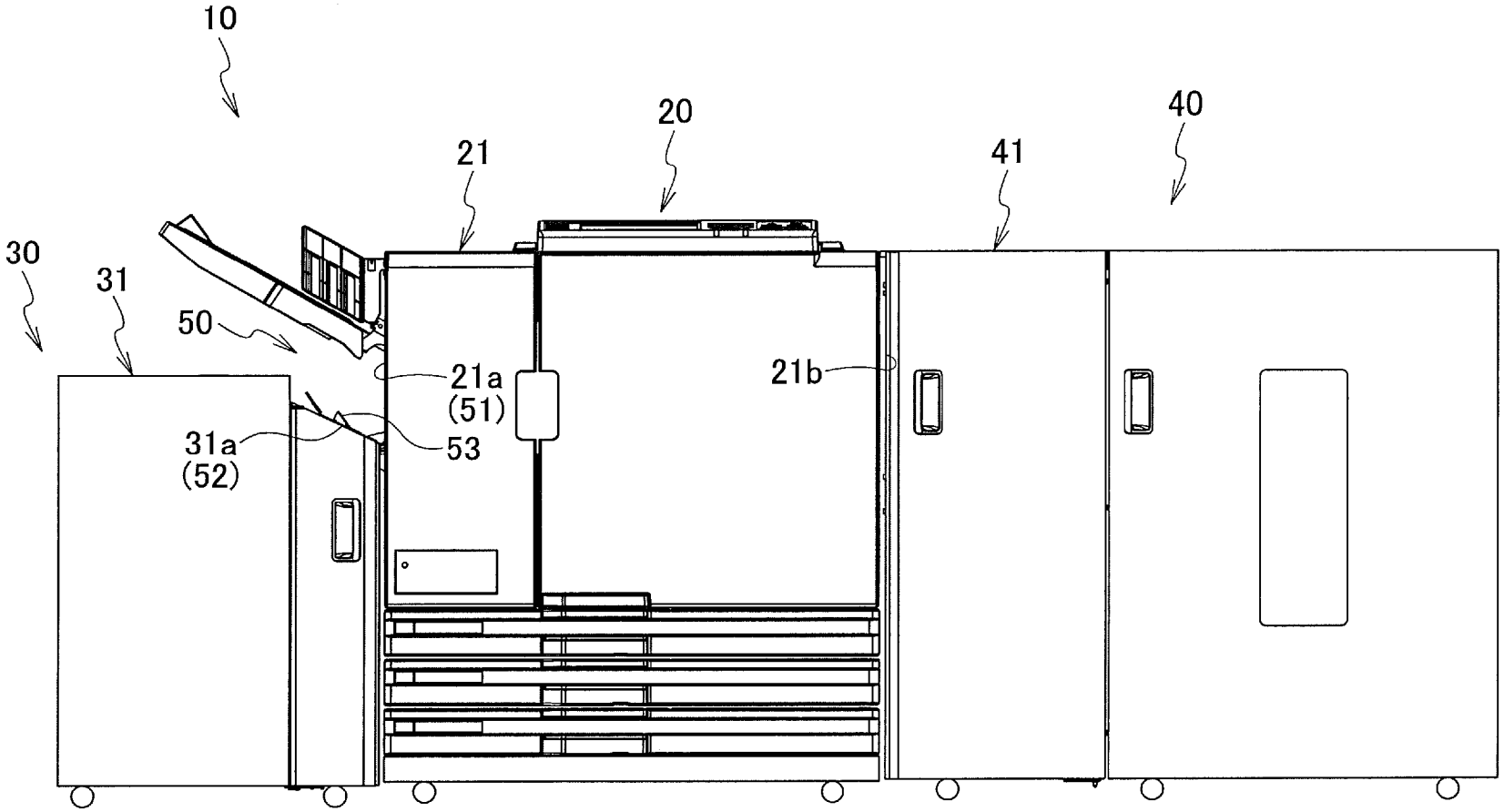
FIG. 1 is a front view of an image forming apparatus provided with a door opening and closing device according to an embodiment.
Figure 2A:
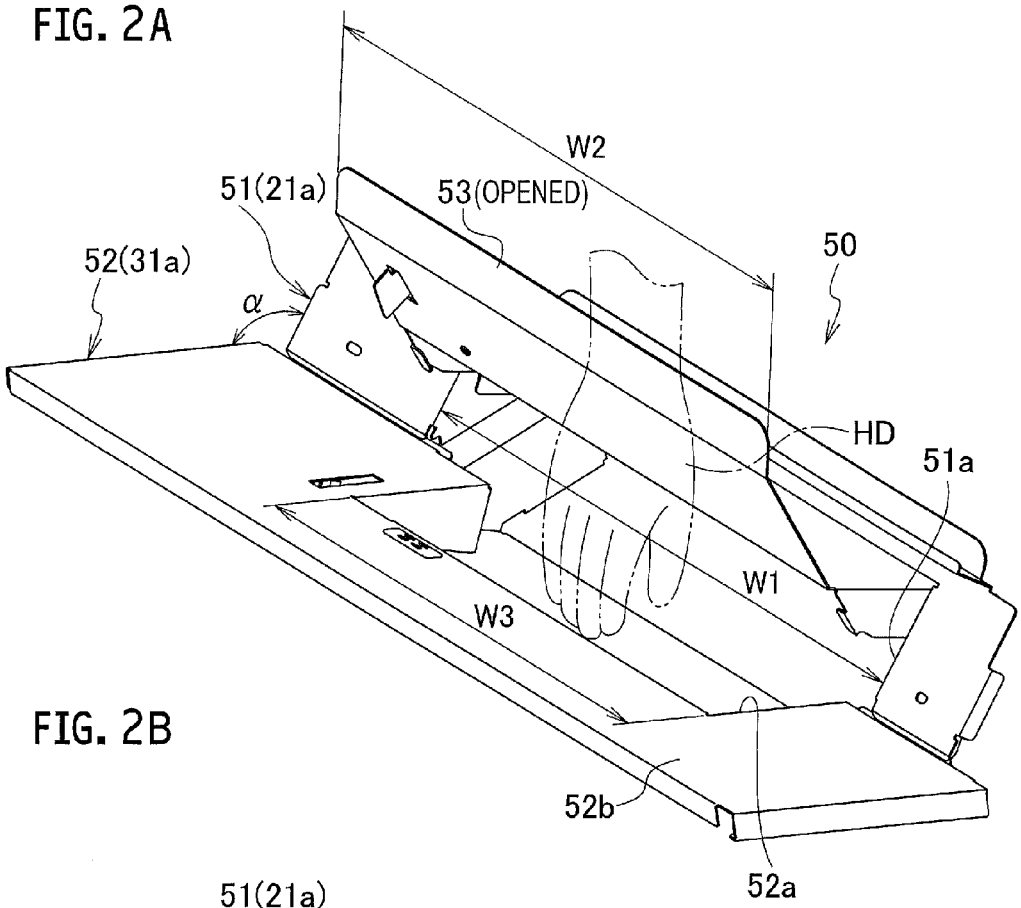
FIG. 2A is a perspective view of the door opening and closing device when a door is opened.
Figure 2B:
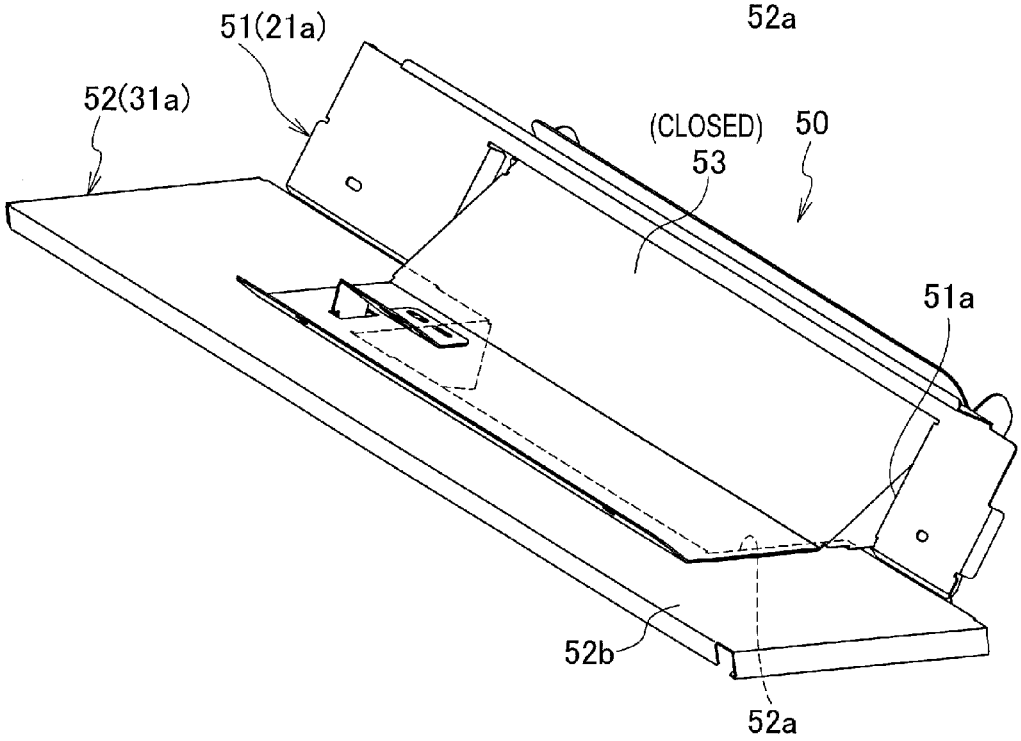
FIG. 2B is a perspective view of the door opening and closing device when the door is closed.

In the present embodiment, the door opening and closing device 50 includes a door 53 that opens and closes an opening(s) formed in the device [see FIG. 2A and FIG. 2B]. In the present embodiment, the door opening and closing device 50 can be adopted in various apparatus and machines, but is adopted in an image forming system 10 including eternal auxiliary devices 30 and 40 [see FIG. 1].

As shown in FIG. 1, the image forming system 10 includes an image forming apparatus 20, a large-capacity paper feeder 30, and a multiple post-processing device 40. The large-capacity paper feeder 30 and the multiple post-processing device 40 are the eternal auxiliary devices of the image forming apparatus 20. The image forming apparatus 20 forms images on a paper by a copying method or the like. The large-capacity paper feeder 30 supplies a copious amount of papers sequentially to the image forming apparatus 20. The multiple post-processing device 40 carries out a post process to papers on which images are already formed, such as a stapling process, a punching process, a cutting process and so on.

The large-capacity paper feeder 30 is detachably connected with a left side panel 21*a* of a first main body 21 of the image forming apparatus 20. In addition, the multiple post-processing device 40 is detachably connected with a right side panel 21*b* of the first main body 21 of the image forming apparatus 20. Note that the first main body 21 of the image forming apparatus 20, a second main body 31 of the large-capacity paper feeder 30, and a third main body 41 of the multiple post-processing device 40 are provided independently from each other, but not limited to this configuration. For example, it is possible to provide components of the large-capacity paper feeder 30 and/or components of the multiple post-processing device 40 integrally in the first main body 21.

The door opening and closing device 50 is disposed between the left side panel 21*a* of the first main body 21 of the image forming apparatus 20 and a upper right portion 31*a* of the second main body 31 of the large-capacity paper feeder 30. The left side panel 21*a* of the first main body 21 functions as an after-described door supporting portion 51 provided in the door opening and closing device 50. The upper right portion 31*a* of the second main body 31 functions as an after-described door receiving portion 52 provided in the door opening and closing device 50.

The door opening and closing device 50 is provided for opening a door 53 that is included in the door opening and closing device 50 so as to be able to be opened and closed when a paper jam occurs for any reason during feeding of papers to the image forming apparatus 20. The door 53 is opened in order to remove a jammed paper JP [see FIG. 7 to FIG. 10] manually (by a hand HD [see FIG. 2A, FIG. 9 and FIG. 10]) through an opening(s) that is included in the door opening and closing device 50, and is opened and closed by the door 53. Of course, it is possible to provide a door opening and closing device (50) between the image forming apparatus 20 and the multiple post-processing device 40 for clearing a paper jam that may occurs during feeding of papers on which images are already formed to the multiple post-processing device 40. However, this case is not shown in the drawings.

Configuration of the door opening and closing device 50 will be explained with reference to FIG. 2A to FIG. 5.

As shown in FIG. 2A, the door opening and closing device 50 includes a door supporting portion 51 and a door receiving portion 52. The door supporting portion 51 is formed by blanking and bending a metal sheet so as to form a first opening 51*a*. The door receiving portion 52 is formed blanking and bending a metal sheet so as to form a second opening 52*a*. The door supporting portion 51 and the door receiving portion 52 are continued to each other so as to make an angle $\alpha$ therebetween, and the first opening 51*a* of the door supporting portion 51 and the second opening 52*a* of the door receiving portion 52 are continued to each other. The door receiving portion 52 is disposed almost horizontally. Therefore, a single large opening is formed by a combination of the first opening 51*a* and the second opening 52*a* between the door supporting portion 51 and the door receiving portion 52.

The door supporting portion 51 is formed so as to be associated with the left side panel 21*a* of the image forming apparatus 20 as explained above with reference to FIG. 1. Namely, the door supporting portion 51 is shown by enlarging a portion of the left side panel 21*a*. Similarly, the door receiving portion 52 is formed so as to be associated with the upper right portion 31*a* of the second main body 31 of the large-capacity paper feeder 30 as explained above with reference to FIG. 1. Namely, the door receiving portion 52 is shown by enlarging a portion of the upper right portion 31*a*. A width W1 of the first opening 51*a* is made slightly larger than a width W2 of the door 53. Therefore, both lateral sides of an axial side of the door 53 are inserted into the first opening 51*a* when the door 53 is closed as show in FIG. 2B, and thereby the door supporting portion 51 holds (the both lateral sides of) the closed door 53.

The door receiving portion 52 receives an open-end side of the door 53 so that the open-end side can be freely contacted with the door receiving portion 52 and the open-end side can be freely separated from the door receiving portion 52. An upper panel 52*b* of the door receiving portion 52 is formed flat. Note that the upper panel 52*b* is a portion excluding the second opening 52*a*. A width W3 of the second opening 52*a* is made smaller than the width W2 of the door 53. But the second opening 52*a* has a size enough for an insertion of a hand HD therethrough in order to remove a jammed paper JP [see FIG. 7 to FIG. 10].

When the door 53 is opened as shown in FIG. 2A, both of the first opening 51*a* on the door supporting portion 51 and the second opening 52*a* on the door receiving portion 52 are opened, so that a hand HD can be inserted through the first opening 51*a* and the second opening 52*a*. The door opening and closing device 50 is configured so that the door 53 is opened more widely (opened further). This will be described later in detail.

On the other hand, when the door 53 is closed as shown in FIG. 2B, both of the first opening 51*a* on the door supporting portion 51 and the second opening 52*a* on the door receiving portion 52 are closed. The open-end side of the door 53 is contacted tightly with the upper panel 52*b* around the second opening 52*a*, so that no gap is generated between the door 53 and the door receiving portion 52. Also this will be described later in detail.

Figure 3A:
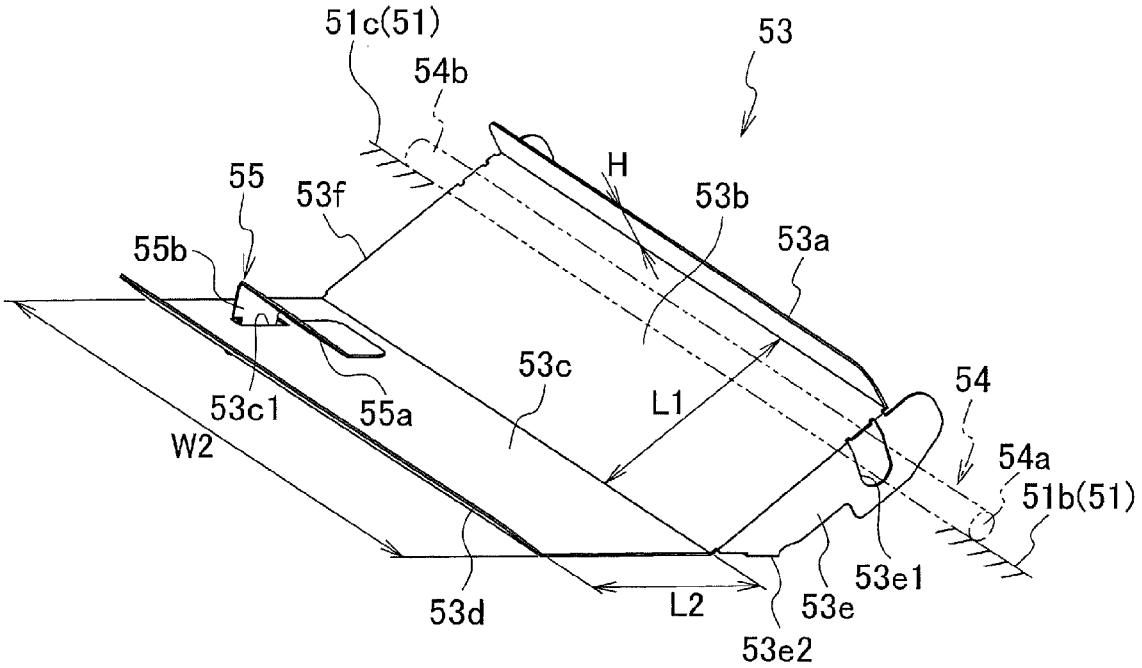
FIG. 3A is a perspective view of the door.
Figure 3B:
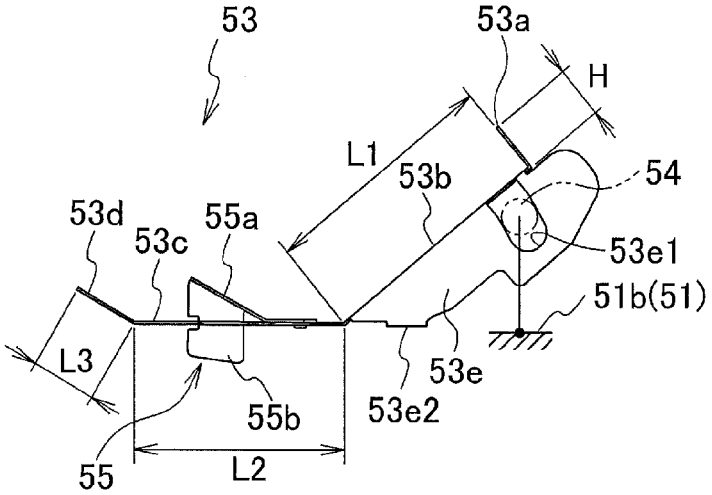
FIG. 3B is a side view of the door.

As shown in FIG. 3A and FIG. 3B, the door 53 is made by bending a metal sheet having an almost 1 mm thickness, and includes a protruded reinforcement flange 53*a*, a first panel (first inclined panel) 53*b*, a second panel (horizontal panel) 53*c* and a third panel (second inclined panel) 53*d*. All the portions 53*a* to 53*d* have the width W2, and are sequentially aligned in this order from the axial side toward the open-end side of the door 53 along a longitudinal direction perpendicular to a direction of the width W2. The first panel (first inclined panel) 53*b* is inclined downward along the longitudinal direction from the axial side toward the open-end side of the door 53. The second panel (horizontal panel) 53*c* is bent so as to form the angle $\alpha$ [see FIG. 2A] with the first panel (first inclined panel) 53*b*. The third panel (second inclined panel) 53*d* is inclined upward along the longitudinal direction from the axial side toward the open-end side of the door 53, i.e. inclined upward with respect to the second panel (horizontal panel) 53*c*.

The protruded reinforcement flange 53*a* is bent upward from an edge of the first panel 53*b* so as to form almost 90 degrees with the first panel 53*b* and to have a low height H. Stiffness of the axial side of the door 53 is made higher by the protruded reinforcement flange 53*a*. The first panel 53*b* has a length L1 from the edge contacting with a lower edge of the protruded reinforcement flange 53*a* to another edge contacting with an edge of the second panel 53*c*. The first panel 53*b* closes the first opening 51*a* on the door supporting portion 51 as described above with reference to FIG. 2A and FIG. 2B.

The second panel 53*c* has a length L2 from the edge contacting with an edge of the first panel 53*b* to another edge contacting with a lower edge of the third panel 53*d* so as to be almost horizontal. The second panel 53*c* closes the second opening 52*a* on the door receiving portion 52 as described above with reference to FIG. 2A and FIG. 2B. The third panel 53*d* has a length L3 from an edge contacting with the other edge of the second panel 53*c* to another edge so as to be inclined upward. The third panel 53*d* functions as a tab to be pinched by a user.

The door 53 also includes a pair of side panels 53*e* and 53*f* that are formed by bending both lateral sides of the first panel 53*b* downward to form almost 90 degrees therebetween, respectively. An elongated hole 53*e*1 (53*f*1: not shown in the drawings) elongated downward is formed on each axial side of the side panels 53*e* and 53*f*, and a shaft 54 is loosely inserted into the elongated holes 53*e*1 and 53*f*1 so as to extend along the direction of the width W2 of the door 53.

E-rings (not shown in the drawings) are attached to the shaft 54 at outer positions from the elongated holes 53*e*1 and 53*f*1 to prevent the shaft 54 from dropping off from the elongated holes 53*e*1 and 53*f*1. In addition, both ends 54*a* and 54*b* of the shaft 54 are supported by a pair of shaft supporting portions 51*b* and 51*c* that are provided on both sides of the first opening 51*a* of the door supporting portion 51. Therefore, the pair of the elongated holes 53*e*1 and 53*f*1 formed on the pair of the side panels 53*e* and 53*f*, and the shaft 54 fixedly supported by the pair of the shaft supporting portions 51*b* and 51*c* function as a pair of first support point points at which both sides of the axial side of the door 53 are supported by the door supporting portion 51 so as to allow the door 53 opened and closed.

Each lower edge 53*e*2 (53*f*2: not shown in the drawings) on the open-end side of the side panels 53*e* and 53*f* is cut horizontally along an extended line from the second panel 53*c*. The lower edges 53*e*2 and 53*f*2 can be freely contacted with the upper panel 52*b* of the door receiving portion 52, and can be freely separated from the upper panel 52*b* of the door receiving portion 52. The lower edges 53*e*2 and 53*f*2 function as a pair of second support point points for swinging of the second panel 53*c* and the third panel 53*d* in their closing direction when the lower edges 53*e*2 and 53*f*2 are contacted with the upper panel 52*b* of the door receiving portion 52. In other words, the lower edges 53*e*2 and 53*f*2 are provided at both lateral sides of an intermediate portion between the axial side and the open-end side of the door 53, and can be freely contacted-with and separated-from the door receiving portion 52.

A bracket 55 is welded on a right side on the second panel 53*c* of the door 53, and includes an inclined tab 55*a* inclined upward and a protruded tab 55*b* extended downward from a side edge of the inclined tab 55*a*. The protruded tab 55*b* is extended to a lower side of the second panel 53*c* through a rectangular hole 53*c*1 formed on the second panel 53*c*. When the door 53 is opened, the inclined tab 55*a* of the bracket 55 is magnetically attracted to a first magnet 56 [see FIG. 9 and FIG. 10] attached to the door supporting portion 51. When the door 53 is closed, the protruded tab 55*b* is engaged with a positioning hole 52*b*1 [see FIG. 5] to set (fix) a position of the door 53.

Figure 4:
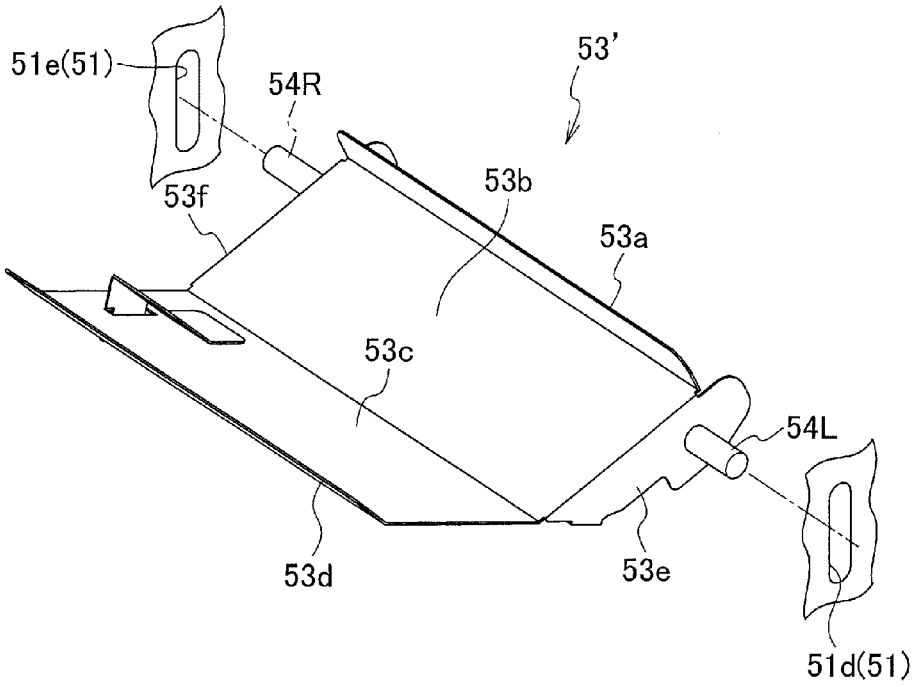
FIG. 4 is a perspective view showing a modified example of the door.

The door 53 in the present embodiment may be modified as shown in FIG. 4. A door 53' according to a modified example also includes the protruded reinforcement flange 53*a*, the first panel (first inclined panel) 53*b*, the second panel (horizontal panel) 53*c* and the third panel (second inclined panel) 53*d*, similarly to the door 53 in the above-described embodiment. However, a pair of first support point points provided on the side panels 53*e* and 53*f* in the present modified example is different from the pair of first support point points in the above-described embodiment.

A shaft 54L is protruded laterally outward from the side panel 53*e*, and a shaft 54R is protruded laterally outward from the side panel 53*f*. An elongated hole 51*d* (51*e*)

elongated downward is formed on each side of the first opening 51*a*. The pair of the shafts 54L and 54R is loosely inserted into the elongated holes 51*d* and 51*e*. Therefore, the pair of the shafts 54L and 54R fixedly attached to the pair of the side panels 53*e* and 53*f*, and the pair of the elongated holes 51*d* and 51*f* formed on the door supporting portion 51 function as a pair of first support point points at which both sides of the axial side of the door 53 are supported by the door supporting portion 51 so as to allow the door 53 opened and closed.

As described in the door 53 of the above embodiment and the modified door 53' of the above modified example, it is enough that the pair of the first support point points is formed by providing a shaft (54) or a pair of shafts (54L and 54R) at one of the axial side of the door (53, 53') and the sides of the first opening 51*a* of the door supporting portion 51 and providing a pair of elongated holes (53*e*1 and 53*f*1, 51*d* and 51*e*) at another of the axial side of the door (53, 53') and the sides of the first opening 51*a*.

Figure 5:
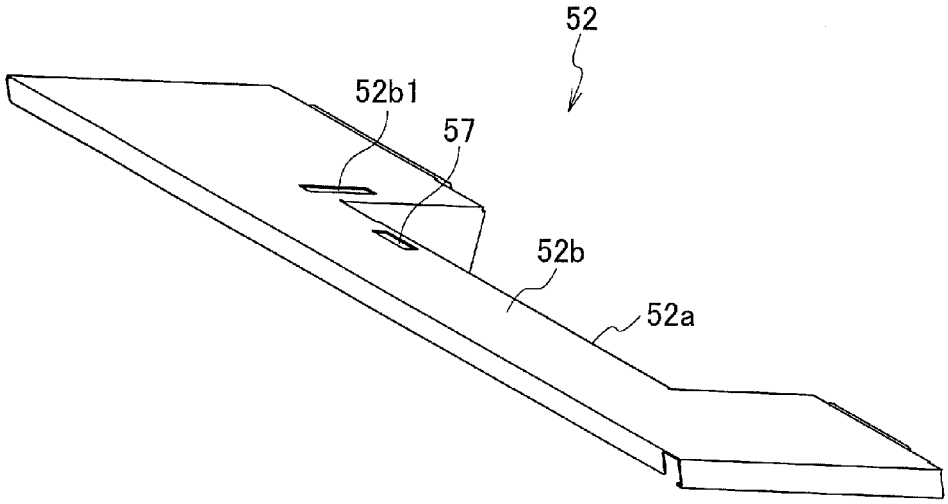
FIG. 5 is a perspective view of a door receiving portion.

As shown in FIG. 5, the second opening 52*a* for removing a jammed paper JP [see FIG. 7 to FIG. 10] therethrough is formed on the door receiving portion 52, and outer circumferential edges of the flat upper panel 52*b* of the door receiving portion 52 are bent downward to keep rigidity (stiffness) of the upper panel 52*b*. A second magnet 57 is mounted on the upper panel 52*b* of the door receiving portion 52, and the above-described positioning hole 52*b*1 is formed on the upper panel 52*b* nearby the second magnet 57.

When the door 53 is closed, the second panel 53*c* of the door 53 is attracted by the second magnet 57 to be tightly contacted with the upper panel 52*b* of the door receiving portion 52. In addition, the protruded tab 55*b* [see FIG. 3] of the bracket 55 welded on the door 53 is engaged with the positioning hole 52*b*1 formed on the upper panel 52*b* to set (fix) a position of the door 53.

Operations of the door opening and closing device 50 will be described hereinafter with reference to FIG. 6A to FIG. 6C. Following description will be made only with respect to the right side panel 53*e* of the door 53, and description with respect to the left side panel 53*f* of the door 53 will be omitted. This is because the operations on the left side panel 53*f* are made symmetrically to those on the right side panel 53*e*.

Figure 6A:
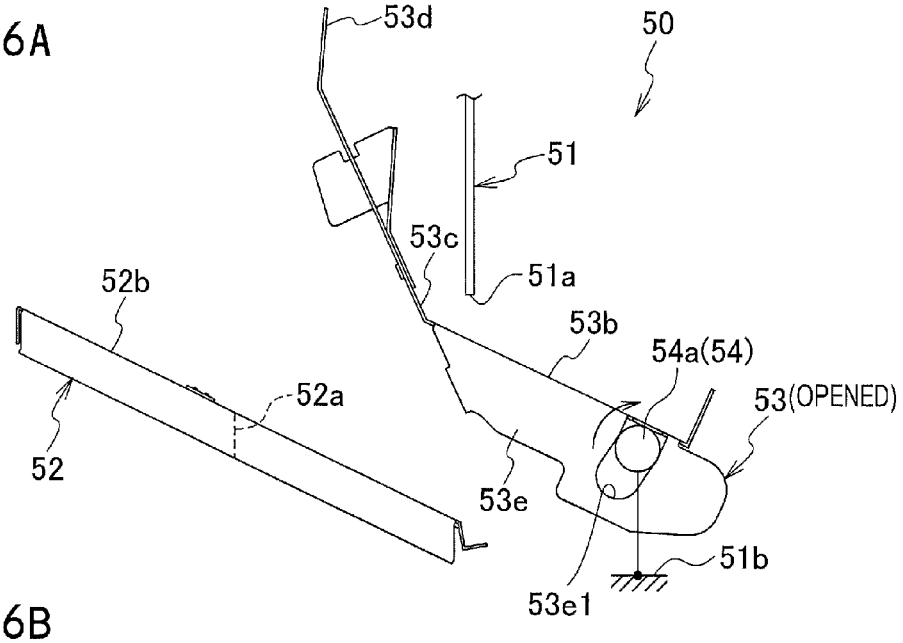
FIG. 6A is a side view of the door opening and closing device when the door is opened.

As shown in FIG. 6A, the first support point for opening and closing the door 53 is configured in a state where the shaft 54 whose end 54*a* fixedly supported by the shaft supporting portion 51*b* of the door supporting portion 51 is loosely inserted though the elongated hole 53*e*1 formed on the axial side of the side panel 53*e* of the door 53. The door 53 is swung about the shaft 54 to be opened while the third panel 53*d* formed on the open-end side of the door 53 is pinched by a user, so that the second panel 53*c* and the first panel 53*b* of the door 53 are separate from the upper panel 52*b* of the door receiving portion 52 to open the door 53 upward. While the door 53 is opened, the shaft 54 is located at an upper position within the elongated hole 53*e*1, and the first opening 51*a* on the door supporting portion 51 and the second opening 52*a* on the door receiving portion 52 are opened, of course. Therefore, a hand HD can be inserted through the first opening 51*a* and the second opening 52*a*.

Figure 6B:
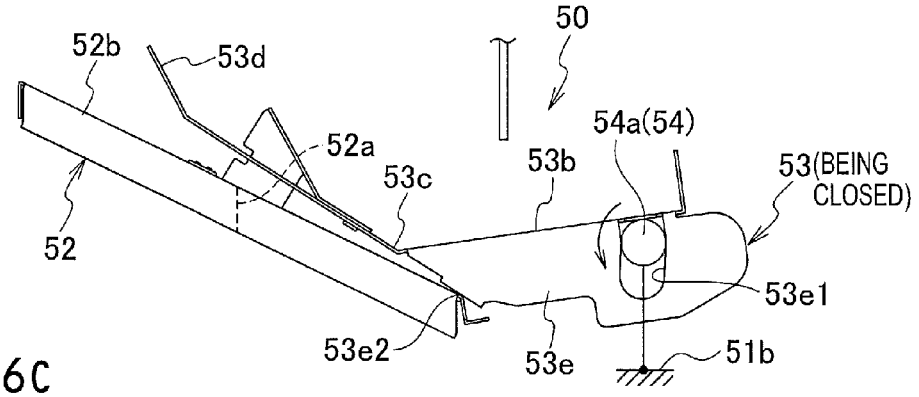
FIG. 6B is a side view of the door opening and closing device when the door is being closed.

As shown in FIG. 6B, when the door 53 is swung about the shaft 54 to be closed, the lower edge 53*e*2 of the side panel 53*e* on the open-end side of the side panel 53*e* contacts with the upper panel 52*b* near the second opening 52*a* of the door receiving portion 52, and the first opening 51*a* of the door supporting portion 51 is closed by the first panel 53*b* of the door 53. Here, the second panel 53*c* of the door 53 is not planarly contacts with the upper panel 52*b* of the door receiving portion 52, and thereby the second opening 52*a* of the door receiving portion 52 is about to be fully closed. Even while the door 53 is closed, the shaft 54 is located at an upper position within the elongated hole 53*e*1.

Figure 6C:
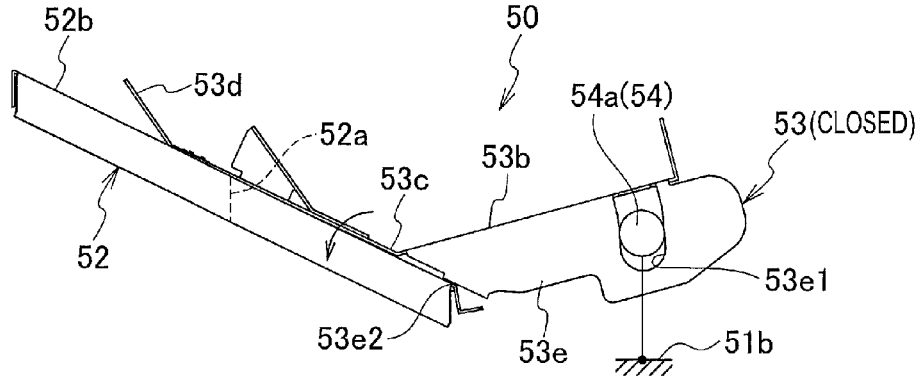
FIG. 6C is a side view of the door opening and closing device when the door is closed.

As shown in FIG. 6C, after the lower edge 53*e*2 of the side panel 53*e* contacts with the upper panel 52*b*, the lower edge 53*e*2 functions as the second support point for closing the door 53. The second panel 53*c* and the third panel 53*d* of the door 53 swing downward about the second support point due to their own weights, and then the second panel 53*c* angled to the first panel 53*b* of the door 53 is tightly (planarly) contacts with the upper panel 52*b* of the door receiving portion 52. As the result, the second opening 52*a* of the door receiving portion 52 is closed with no gap between the second panel 53*c* and the upper panel 52*b*. At this process, the axial side of the first panel 53*b* of the door 53 is slightly move upward, so that the shaft 54 is located at a lower position within the elongated hole 53*e*1.

By bending the open-end side of the door 53 (i.e. the second panel 53*c*) from the second support point (the lower edge 53*e*2) in accordance with an inclined angle of the door receiving portion 52, the open-end side of the door 53 (i.e. the second panel 53*c*) can be planarly contacted with the upper panel 52*b* of the door receiving portion 52, i.e. can be closed tightly. Therefore, the opening (the first opening 51*a* and the second opening 52*a*) formed between the door supporting portion 51 and the door receiving portion 52 can be closed by the door 53 with no gap, and thereby it can be prevented surely that an extraneous material invades through the opening (the first opening 51*a* and the second opening 52*a*) while the door 53 is closed.

Next, a clearing operation of a jammed paper JP in the large-capacity paper feeder 30 will be described with reference to FIG. 7 to FIG. 10. Similarly to the above description, following description will be made only with respect to the right side panel 53*e* of the door 53. Note that FIG. 7 to FIG. 10 show a state where a jammed paper JP is jammed on a paper feed path 32 provided in the large-capacity paper feeder 30 for any reason during feeding of paper from the large-capacity paper feeder 30 to the image forming apparatus 20 in the image forming system 10 to which the door opening and closing device 50 is adopted.

Figure 7:
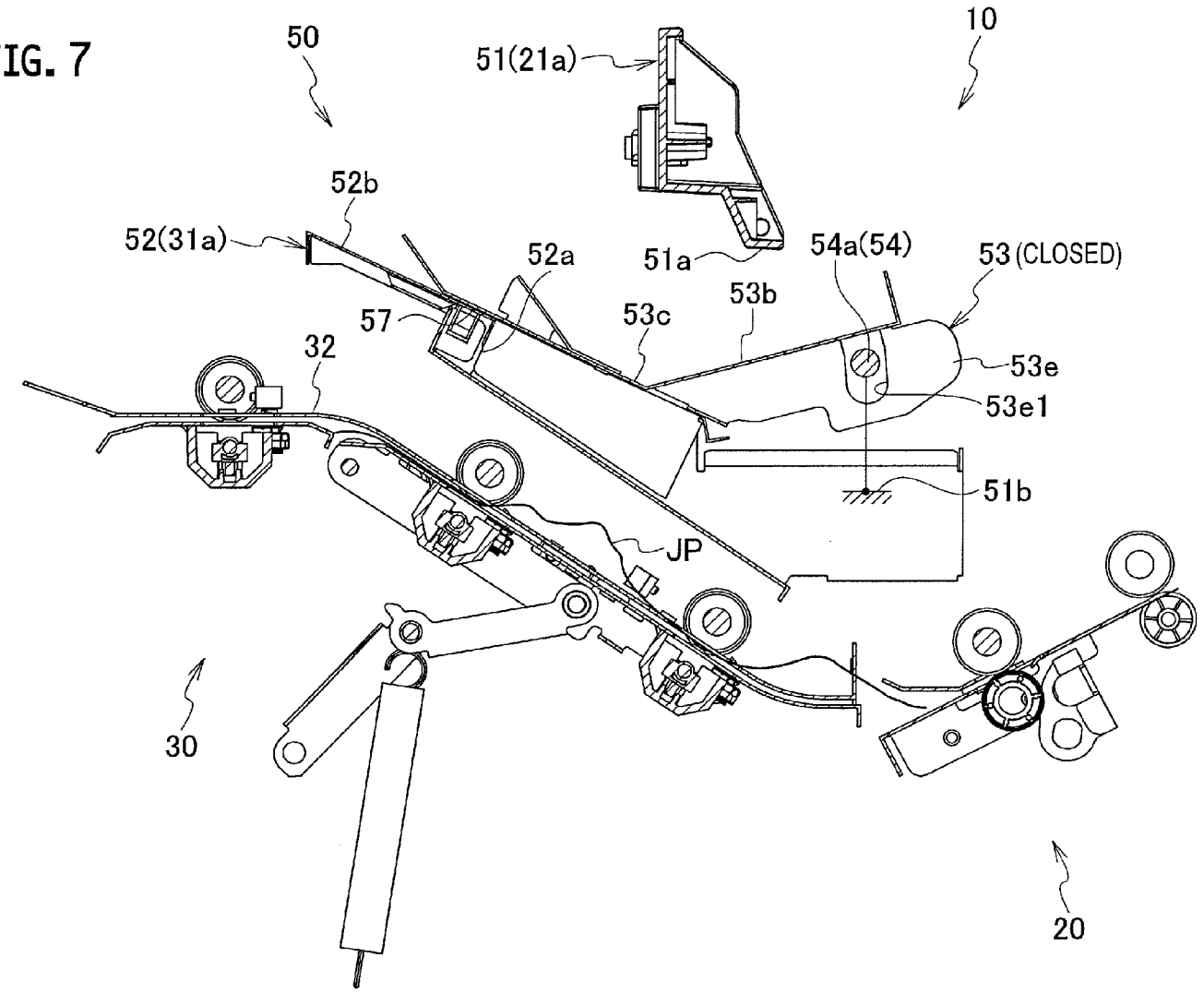
FIG. 7 is a side view of the door opening and closing device when clearing a paper jam (the door is closed)

As shown in FIG. 7, the shaft 54 of which the end 54*a* is supported by the shaft supporting portion 51*b* of the door supporting portion 51 is loosely inserted through the elongated hole 53*e*1 formed on the axial side of the right side panel 53*e*. While the door 53 is closed, the second panel 53*c* of the door 53 is magnetically attracted onto the upper panel 52*b* of the door receiving portion 52 by the second magnet 57, and the first opening 51*a* on the door supporting portion 51 and the second opening 52*a* on the door receiving portion 52 are closed by the first panel 53*b* and the second panel 53*c* of the door 53. Note that, in FIG. 7, the door supporting portion 51 is associated with the left side panel 21*a* of the first main body 21 of the image forming apparatus 20, and the door receiving portion 52 is associated with the upper right portion 31*a* of the second main body 31 of the large-capacity paper feeder 30, as described above with reference to FIG. 1. When a paper jam occurs on the paper feed path provided in the large-capacity paper feeder 30 for any reason, a warning for removing a jammed paper JP is output on an operation panel (not shown in the drawings).

Figure 8:
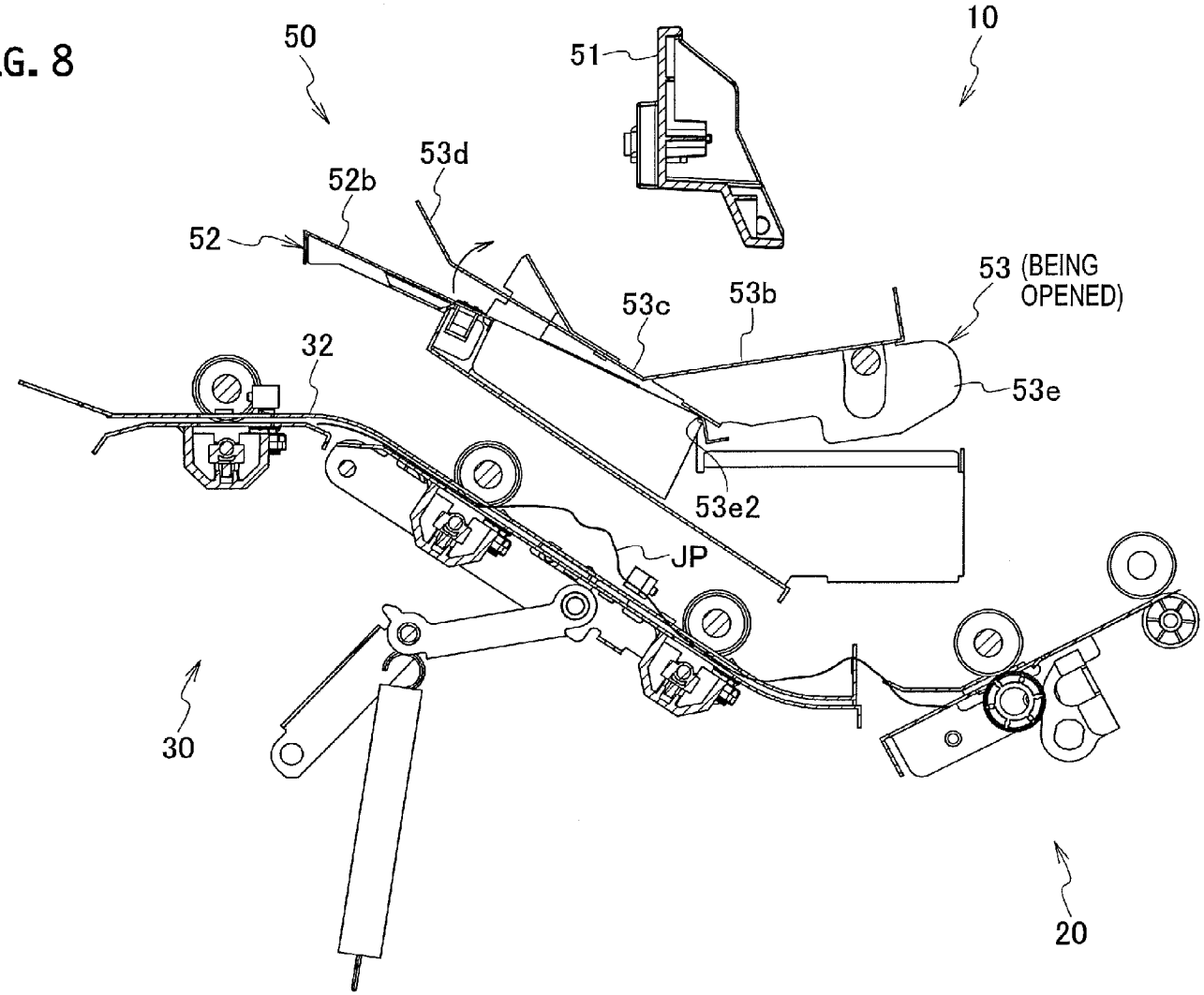
FIG. 8 is a side view of the door opening and closing device when clearing the paper jam (the door is being opened)

As shown in FIG. 8, a user picks up the third panel 53*d* (pinching tab) of the door 53 according to the warning, so that the lower edge 53*e*2 on the open-end side of the right side panel 53*e* of the door 53 functions as the second support point and the second panel 53*c* of the door 53 is swung about the second support point. As the result, the second panel 53*c* of the door 53 is separated from the upper panel 52 of the door receiving portion 52.

Figure 9:
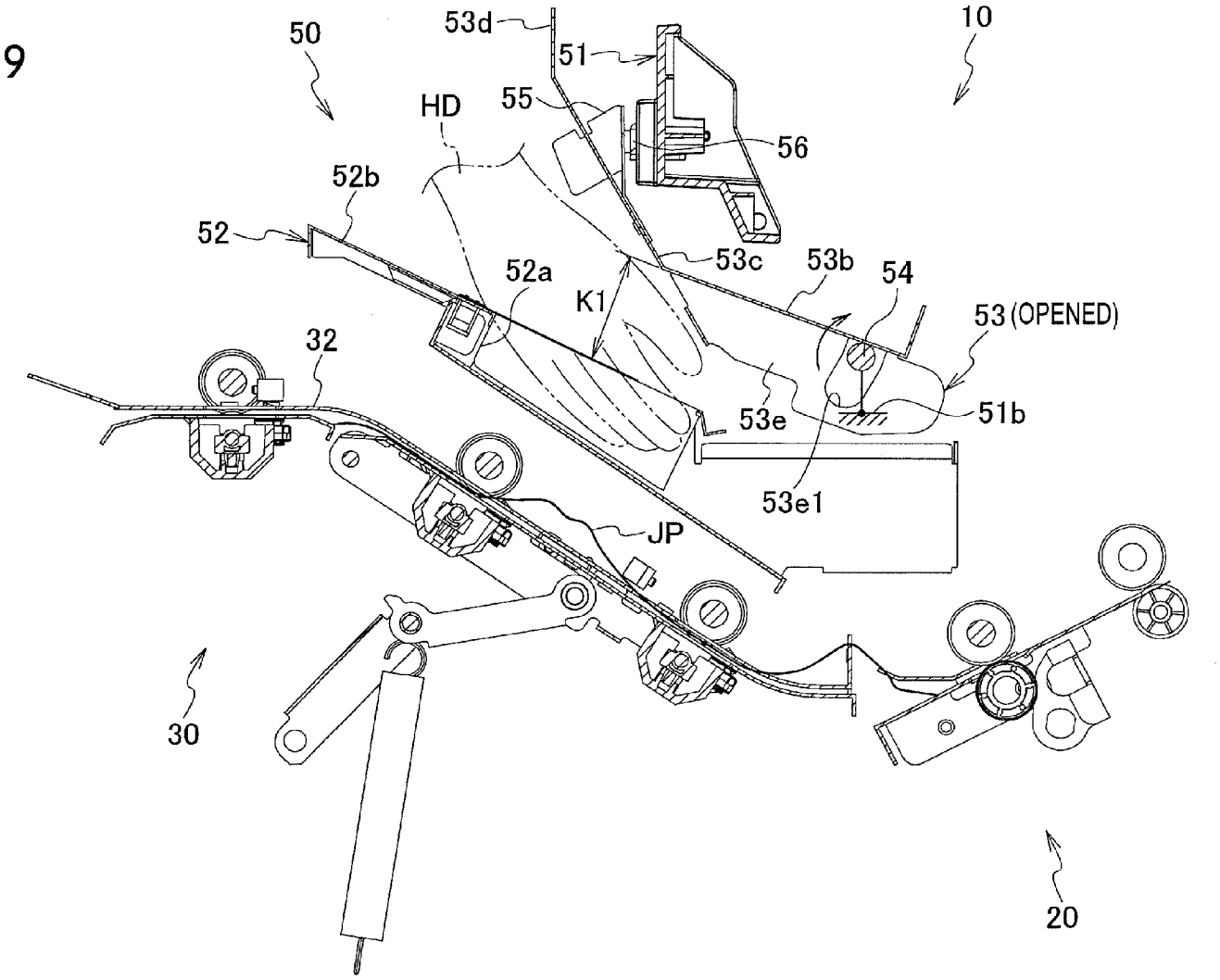
FIG. 9 is a side view of the door opening and closing device when clearing the paper jam (the door is opened)

As shown in FIG. 9, the user further picks up the third panel 53*d* (pinching tab) of the door 53, so that the door 53 is swung, to be opened, about the shaft 54 that is supported by the shaft supporting portion 51*b* and functions as the first support point. Then the bracket 55 welded on the second panel 53*c* of the door 53 is magnetically attracted by the first magnet 56 provided on the door supporting portion 51, and thereby the door 53 is held by the first magnet 56. Since the shaft 54 is located at an upper position within the elongated hole 53*e*1 at the state shown in FIG. 9, a distance K1 between the first panel 53*b* of the door 53 and the upper panel 52*b* near the second opening 52*a* on the door receiving portion 52 is narrow. Therefore, workability by a hand HD is not good.

Figure 10:
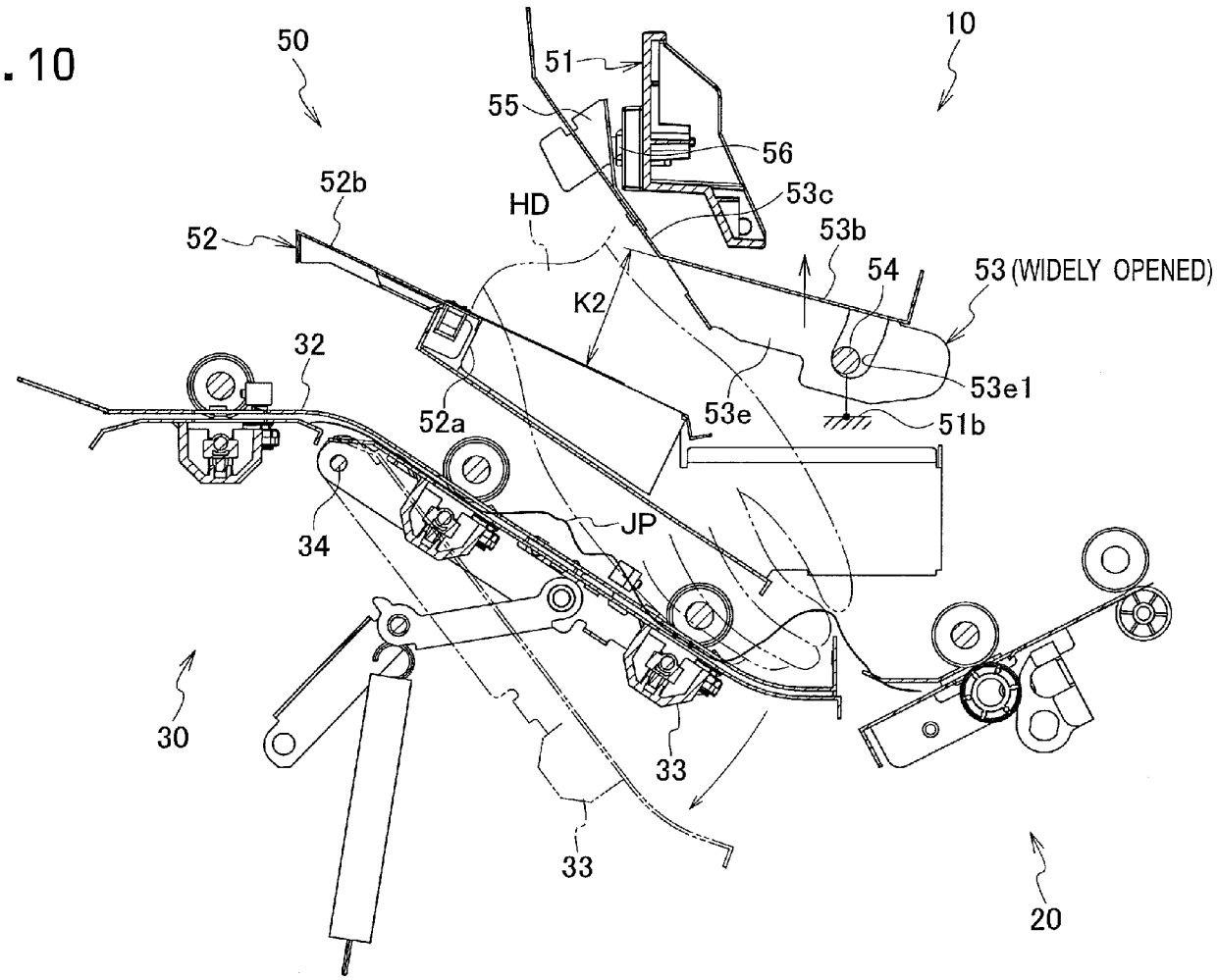
FIG. 10 is a side view of the door opening and closing device when clearing the paper jam (the door is widely opened).

As shown in FIG. 10, even while the second panel 53*c* of the door 53 is magnetically held by the first magnet 56 provided on the door supporting portion 51, the elongated hole 53*e*1 formed on the open-end side of the right side panel 53*e* of the door 53 can be moved relatively to the shaft 54 supported by the door supporting portion 51. Therefore, when the hand HD inserted into the opening (the first opening 51*a* and the second opening 52*a*) contacts with a lower surface of the first panel 53*b* of the door 53, the first panel 53*b* of the door 53 is moved upward.

When the first panel 53*b* of the door 53 is moved upward by the hand HD, the shaft 54 supported by the door supporting portion 51 contacts with a lower inner edge of the elongated hole 53*e*1 formed on the open-end side of the right side panel 53*e* of the door 53, and thereby a further upward movement of the first panel 53*b* of the door 53 is restricted. As the result, the distance K1 between the first panel 53*b* of the door 53 and the upper panel 52*b* near the second opening 52*a* on the door receiving portion 52 is widen to a distance K2, and the hand HD can be easily inserted into the opening (the first opening 51*a* and the second opening 52*a*).

Therefore, in a case where the door opening and closing device 50 is adopted in the image forming system 10, an open angle of the door 53 (53') can be widened by a combination of the shaft and the elongated hole at the first support point when the door 53 (53') is opened. As the result, a jammed paper JP remained in the image forming system 10 can be removed easily, and a service part can be replaced easily.

Note that, when a paper jam occurs on the paper feed path 32 provided in the large-capacity paper feeder 30, a jammed paper JP can be removed more easily by swinging a lower-side paper guide plate 33 downward about an axis 34 [see FIG. 10].

The present invention is not limited to the above-mentioned embodiment and modified examples, and it is possible to embody the present invention by modifying its components in a range that does not depart from the scope thereof. Further, it is possible to form various kinds of inventions by appropriately combining a plurality of components disclosed in the above-mentioned embodiment and modified examples. For example, it may be possible to omit several components from all of the components shown in the above-mentioned embodiment.

The present application claims the benefit of a priority under 35 U.S.C. §119 to Japanese Patent Application No. 2014-152981, filed on Jul. 28, 2014, the entire content of which is incorporated herein by reference.

What is claimed is:

1. An image forming system comprising:

an image forming apparatus and an external auxiliary device removably attached to the image forming apparatus, wherein the image forming apparatus includes:

a door that is capable of being opened and closed, and the door includes an axial side and an open-end side, the open-end side of the door being angled to the axial side of the door to form an angle therebetween; and a door supporting portion that supports the axial side of the door, wherein the external auxiliary device includes:

a door receiving portion that extends continuously from the door supporting portion and that receives the open-end side of the door, the door receiving portion being inclined to the door supporting portion to form an inclined angle ($\alpha$) therebetween, wherein the image forming system further comprises:

an opening that is formed from the door supporting portion to the door receiving portion, and is opened and closed by the door;

a first support point that is made by a combination of a shaft and an elongated hole, the shaft is attached to one of the axial side of the door and the door supporting portion, and the elongated hole is formed on the other of the axial side of the door and the door supporting portion, the shaft being loosely inserted into the elongated hole; and a second support point that is provided on the door and that is capable of contacting the door receiving portion and of being separated from the door receiving portion, and wherein the door can be opened by swinging the axial side of the door about the first support point and by the shaft moving in the elongated hole.

2. An image forming system comprising:

an image forming apparatus and an external auxiliary device removably attached to the image forming apparatus, wherein the image forming apparatus includes:

a door that is capable of being opened and closed, and the door includes an axial side and an open-end side, the open-end side of the door being angled to the axial side of the door to form an angle therebetween; and a door supporting portion that supports the axial side of the door, wherein the external auxiliary device includes:

a door receiving portion that extends continuously from the door supporting portion and that receives the open-end side of the door, the door receiving portion being inclined to the door supporting portion to form an inclined angle ($\alpha$) therebetween, wherein the image forming system further comprises:

an opening that is formed from the door supporting portion to the door receiving portion, and is opened and closed by the door;

a first support point that is made by a combination of a shaft and an elongated hole, the shaft is attached to one of the axial side of the door and the door supporting portion, and the elongated hole is formed on the other of the axial side of the door and the door supporting portion, the shaft being loosely inserted into the elongated hole; and a second support point that is provided on the door and that is capable of contacting the door receiving portion and being separated from the door receiving portion, and wherein the door can be closed by swinging the axial side of the door about the first support point until the second support point of the door contacts the door receiving portion which causes the open-end side of the door to swing about the second support point due to the weight of the open-end side of the door so that the door further engages with the door receiving portion and the shaft moves in the elongated hole.

* * * * *